US007877821B1

(12) United States Patent
Prestia

(10) Patent No.: US 7,877,821 B1
(45) Date of Patent: Feb. 1, 2011

(54) PORTABLE COMPRESSED-AIR GUN FOR UNCLOGGING SINGLE DRAINS

(76) Inventor: Giuseppe Prestia, 309 Lime Cir., Sarasota, FL (US) 34237

( * ) Notice: Subject to any disclaimer, the term of this patent is extended or adjusted under 35 U.S.C. 154(b) by 353 days.

(21) Appl. No.: 12/209,075

(22) Filed: Sep. 11, 2008

(51) Int. Cl.
*E03D 9/00* (2006.01)

(52) U.S. Cl. ..... 4/255.04; 4/255.01; 4/255.05

(58) Field of Classification Search .... 4/255.01–255.09
See application file for complete search history.

(56) References Cited

U.S. PATENT DOCUMENTS

| | | | | |
|---|---|---|---|---|
| 4,063,317 | A * | 12/1977 | Santore | 4/255.01 |
| 5,530,988 | A * | 7/1996 | McQuillan | 4/255.06 |
| 6,892,401 | B1 * | 5/2005 | Mangum | 4/255.06 |
| 2003/0028957 | A1 * | 2/2003 | Kawai | 4/255.01 |
| 2006/0282941 | A1 * | 12/2006 | Wang | 4/255.06 |
| 2007/0266485 | A1 * | 11/2007 | Tackett | 4/255.04 |
| 2010/0132101 | A1 * | 6/2010 | Bates et al. | 4/255.04 |

FOREIGN PATENT DOCUMENTS

FR 2615545 A1 * 5/1988

* cited by examiner

*Primary Examiner*—Khoa D Huynh

(57) ABSTRACT

A hand-held gun-shaped device having an air compressor, an air chamber, and at least one detachable drain-sealing adapter, which are used together to clear soft stoppages from single drains. Air compressor power may be supplied by a removable power cord or battery. Optional features include a detachable side handle, a toilet plunger adapter, a hollow cup adapter for shower and kitchen sink drains, a funnel-shaped adapter for bathtub and sink drains, an air compressor tire valve, a tire valve attachment, a safety-release valve, and a pressure gauge. An operator sets the PSI setting dial or display on the air compressor above a needed threshold air chamber pressure and starts the air compressor. When the air compressor stops and an air chamber release button is activated, a drain-unclogging air burst is released from the air chamber. One charge of the air chamber provides one air burst.

8 Claims, 4 Drawing Sheets

FIG. 3
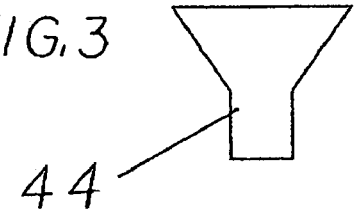
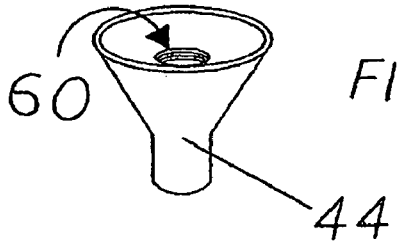
FIG. 4
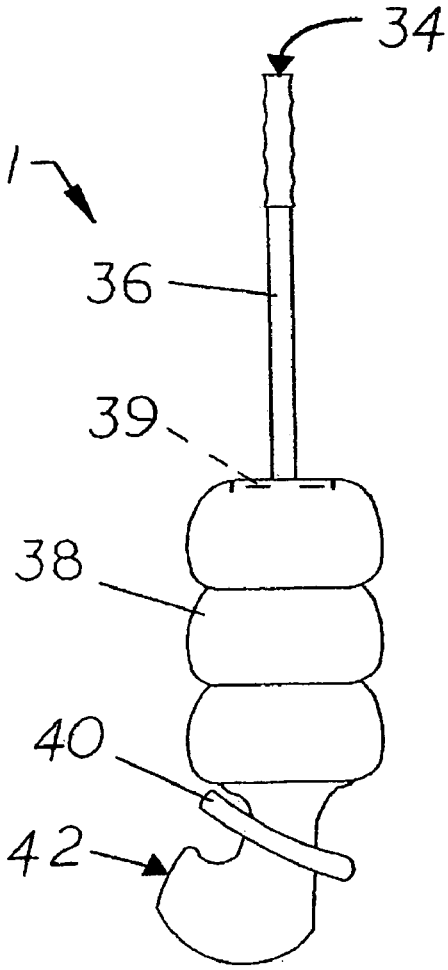
FIG. 5
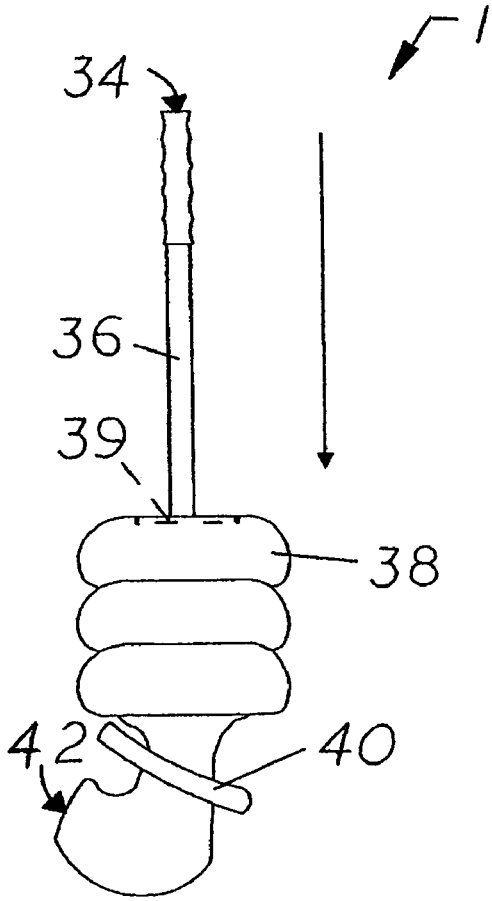
FIG. 6

PORTABLE COMPRESSED-AIR GUN FOR UNCLOGGING SINGLE DRAINS

CROSS-REFERENCES TO RELATED APPLICATIONS

None

BACKGROUND

1. Field of the Invention

This invention relates to the field of drain unclogging devices, specifically to a portable, hand-held gun-shaped device (for professional and non-professional use) having a small air compressor in fluid connection with an air chamber, and at least one detachable drain-sealing adapter, which are used together to safely and rapidly clear soft stoppages from single drains. Power may be supplied for the air compressor by a power cord (preferably removable) to provide alternating current to the air compressor or battery means (preferably rechargeable) may be used. Optional features include a removable side handle for leverage, a toilet plunger adapter, a hollow cup adapter for shower and kitchen sink drains, a funnel-shaped adapter for bathtub and sink drains, a tire air compressor valve, a tire valve attachment, a safety-release valve, and a pressure gauge for the air chamber. If the air chamber is not charged above the minimum pressure needed for unclogging a drain, prior to present invention use the operator sets the PSI setting dial (which may have a digital display) on the air compressor to a desired air pressure setting above the threshold PSI needed to unclog the drain. The operator then starts the air compressor using the on-off switch. When the air pressure in the air chamber reaches the pre-selected PSI on the PSI setting dial, a pressure switch connected between the air chamber and the air compressor causes the air compressor to shut off. A forceful burst of air used to clear a soft stoppage from a single drain can then be discharged from the air chamber through manual activation of the air chamber release button positioned in a conveniently accessible location on the air chamber. The air burst travels through the main discharge opening in the air chamber and then through an adapter (such as a toilet plunger adapter) connected to the main discharge opening so that its check valve becomes disengaged by a pin in the main discharge opening of the air chamber. The distal end of the adapter is aligned with drain opening to provide a substantially airtight seal it before the air burst is released. One charge of the air chamber provides one air blast, so that if a second air burst is needed to clear the drain, the operator needs to recharge the air chamber. In addition, the portable present invention device can be used as a mini air compressor when a tire valve accessory is connected to an optional tire air compressor valve on the air chamber and the PSI setting dial is set to the air pressure desired in the tire (also ball, other inflatable device, or to pressurize plumbing systems for leak testing). Thereafter, an operator is able to activate the on-off switch for substantially even transfer of air automatically from the air chamber into the tire or other inflatable device until the pre-selected PSI is reached. When this occurs, the pressure switch between the air chamber and the air compressor turns off the air compressor, after which the tire valve accessory can be disconnected from the air chamber so that it can again be used for drain unclogging use.

2. Description of the Related Art

Clogged drains are often encountered and require different approaches for clearing them. Many non-professionals attempt to clear soft stoppages using liquids or a tool. Liquids have many disadvantages, including slow action, handling precautions, and environmental concerns. In addition, most tools currently available for drain clearing do not work effectively, are inconsistent in their result, and/or present a failure risk for plumbing pipe. One example is a flexible bladder that is connectible to a garden hose and, which when filled with water from the hose and placed in contact with a drain clog, acts as a hydraulic ram to break a clog loose. However, it has the disadvantage of also having the potential to cause connections in plastic-pipe drain systems to break loose. In addition, this type of device requires more operator handling, more time to clear a drain clog, and more after-use maintenance than the present invention. Published Patent Application US20050050624 to Pangramuyen (2005) discloses a ball-shaped fracturing nozzle at the leading end of a snaking air hose and an annular splash guard at the drain entry point, wherein a few thrusting blasts can be used to unclog drains. The Pangramuyen device also requires more operator handling, more time to clear a drain clog, and more after-use maintenance than the present invention. In addition, U.S. Pat. No. 2,059,785 to Gaik (1936) discloses a hand-operated air pump with a top handle that is connected to the side of a pressure vessel having a similar top handle and an outlet pipe. The Gaik device further comprises a sponge rubber ball with a watertight skin that provides a seal for the outlet pipe. In contrast to the Gaik invention, the present invention has a different structure, including a gun-shaped configuration that is more balanced in an operator's hand during use. The present invention also has the option of using an additional handle for enhanced leverage. Also, the present invention relies on easier and faster power-assisted filling of its air chamber, instead of hand-operated air pump of the Gaik invention. Further, the present invention is more versatile than the Gaik invention in that the present invention is able to alternatively use various adapters that are each quickly attached and configured for effectively sealing a different type of drain opening, including one that allows use with a strainer plate in place over a drain opening. An alternative drain unclogging device is disclosed in U.S. Pat. No. 4,059,858 to Lambel (1977) which reveals a hand-held device that uses gas pressure, a rupturable metal diaphragm, and a pressure ring for sealing the drain opening. Pressure supplied via a separate pressure can or pump is increased until the prescored diaphragm suddenly ruptures, which provides a hammer-like action against a drain clog. The Lambel device has the disadvantage of requiring a replacement diaphragm each time it is used. In contrast, the present invention has a different configuration and structure that requires no similar component or feature. There are also other inventions disclosed in U.S. Patents that use air or gas pressure to unclog drains. However, their structures are different from that of the present invention, and they all use compressed air or gas provided by an air pump or external source. Such patents include U.S. Pat. No. 4,097,937 to Hofmann (1978) (vertically-oriented air reservoir with connected rubber cup that is positioned over a drain opening), U.S. Pat. No. 4,629,128 to Lawrence (1986) (a gun-shaped device with a trigger-operated pilot valve connected to its handle that quickly exhausts air from one of two chambers and causes a piston and valve to snap rearwardly to open a discharge opening in the second chamber), U.S. Pat. No. 5,669,099 to Porcasi (1997) (a handle component with a rod and piston deliver compressed air to a minor housing after which a spring activated trigger connected to the handle delivers the compressed air into a clogged drain), U.S. Pat. No. 6,032,301 to Wang (2000) (a pressure ball that is connected between an upper base and a correlative tubular shaft, with the tubular shaft extending vertically through the ball and ending in a stopper, can be filled with compressed air from an external source through an air inlet, with the air being released through the shaft and stopper for drain unclogging purposes via a handle pivotally connected to the upper end of the correlative tubular shaft), U.S. Pat. No. 6,892,401 to Mangun (2005) (an air chamber storing compressed air is fluidly connected to a tube having a free end positioned within a drain, whereby two check valves each biased into a retracted position are connected to the air chamber with the first check valve becoming extended at a first pressure and the second one becoming extended to allow air transfer into the tube at a pressure at least 10 psi greater than the first pressure), and U.S. Pat. No. 7,120,943 to Allenbaugh (2006) (a cylindrical chamber receives compressed gas from an outside source and is connected to a burst disk positioned between the cylindrical chamber and a drain opening that harnesses and directs the energy of the compressed gas toward a drain clog).

The drain unclogging device thought to be one of the closest to present invention structure can be found on the Internet website of www.pannomagico.it under the name of Pango Plunger. However, although the Pango Plunger also has a gun-shaped configuration that is easy for an operator to manipulate, many differences exist between it and the present invention. The Pango Plunger uses a pump rod for pressurizing its air chamber, while the present invention instead uses an on-board mini compressor and also comprises a means of providing power for its mini compressor, either in the form of one or more batteries housed in its handle, a power cord, or both. Thus, the operator of the Pango Plunger must exert substantially more effort to fill its air storage chamber than an operator of the present invention who must only set a PSI setting dial or display to the pressure desired in the air chamber and then briefly manipulate an on-off switch to start the air compressor. The present invention also discloses an optional handle (designed for enhanced leverage by the operator's second hand) that can be removably attached to the outside surface of its air chamber. Further, the Pango Plunger invention has a trigger connected to its handle to discharge air from its pressurized chamber, whereas the present invention uses an air-release button connected to its air chamber. No other drain unclogging device is known that functions in the same manner, has the same structure as the present invention, or provides all of its advantages.

BRIEF SUMMARY OF THE INVENTION

The primary object of this invention is to provide an easily portable and hand-held device for unclogging drains that promptly, effectively, and safely clears soft stoppages from single drains. Another object of this invention is to provide a device for unclogging drains that can be used by professionals and non-professionals alike for unstopping toilets, as well as other household drains associated with showers, bathtubs, and sinks. It is a further object of this invention to provide a device for unclogging drains that can be adapted for different applications through the use of interchangeable attachments connected to the air chamber. It is also an object of this invention to provide a device for unclogging drains that can also be used as a miniature portable air compressor to fill bicycle and automobile tires, as well as other inflatable objects. It is a further object of this invention to provide a device for unclogging drains that can be adapted for use with alternative sources of power, including battery power. It is also an object of this invention to provide a device for unclogging drains that is sturdy in construction and easy for an operator to manipulate. A further object of this invention is to provide a device for unclogging drains that is made substantially from lightweight and water-resistant materials.

The present invention, when properly made and used, will provide a portable, hand-held, gun-shaped device that has a small air compressor in fluid communication with an air chamber, and at least one detachable drain-sealing adapter, which are used together to safely and rapidly clear soft stoppages from single drains. It is balanced for easy handling by non-professionals, although professionals may use it as well. Different adapters can be used to unclog different types of drains. Power for the air compressor may be supplied via a power cord (preferably removable) or battery means (preferably rechargeable and optionally removable). Also, an on-off switch must be used to activate the air compressor and turn it off. A pressure switch also can be used to automatically turn off the air compressor to maintain a full charge in air chamber for immediate use whenever a need occurs. Optional features include a removable side handle configured for enhanced leverage, a toilet plunger adapter that also can be used without the present invention device to unclog a toilet, a hollow cup adapter for shower and kitchen sink drains, a funnel-shaped adapter for bathtub and sink drains, a tire air compressor valve mounted on the air chamber for use of the air chamber as a miniature portable air tank to fill automobile or bicycle tires, a tire valve attachment configured for connection between the tire air compressor valve mounted on the air chamber and the air valve of a tire, a safety-release valve to prevent accumulation of excess air pressure within the air chamber above a threshold level considered safe, and a pressure gauge for the air chamber configured to provide visual confirmation of the current amount of air pressure (measured in PSI) present in the air chamber. When the air chamber needs a charge of air for drain unclogging use, an operator sets the PSI setting dial or display on the air compressor above the threshold air chamber pressure needed for unclogging a drain and starts the air compressor using an on-off switch. After the air compressor is stopped by either the on-off switch or a pressure switch monitoring the PSI within the air chamber, indicating that a sufficient charge of pressurized air exists in the air chamber, and also after an adaptor appropriately configured for unclogging the toilet or other type of drain having a soft stoppage is attached to the air chamber discharge opening, an air release button is activated by the operator to send a forceful air burst from the air chamber toward the soft stoppage in the drain to clear it from its drain blocking position. The distal end of the adapter attached to the air chamber is aligned with the drain opening before the air burst is released. One charge of the air chamber provides one air burst, so that if a second air burst is needed to clear the drain, the operator needs to recharge the air chamber. In the alternative, the present invention can be used as a mini air compressor when a tire valve accessory is connected to an optional tire air compressor valve on the air chamber and the PSI setting dial is set to the air pressure desired in a tire, ball, or other inflatable device. Thereafter, an operator is able to activate the on-off switch for substantially even transfer of air automatically from the air chamber into the tire or other inflatable device until the pre-selected PSI is reached. When this occurs, the pressure switch between the air chamber and the air compressor turns off the air compressor, after which the tire valve accessory can be disconnected from the air chamber so that it may be used for further drain unclogging use.

The description herein provides preferred embodiments of the present invention but should not be construed as limiting its scope. For example, variations in the length and diameter dimensions of the air chamber; how much the air chamber narrows at its discharge end, if any; the size of the air compressor; the positioning of a battery relative to the air compressor; the size, configuration, and type of connection for the optional handle attached to the outside surface of the air chamber; the location on the outside surface of the air chamber where the handle is attached, the positioning of a power cord jack, if any; the type, size, configuration, and location of PSI setting means for the air compressor; and the locations of the optional pressure gauge, safety-release valve, and tire air compressor valve on the air chamber, other than those shown and described herein, may be incorporated into the present invention. Thus the scope of the present invention should be determined by the appended claims and their legal equivalents, rather than being limited to the examples given.

BRIEF DESCRIPTION OF THE SEVERAL VIEWS OF THE DRAWINGS

FIG. 3 is a side view of a funnel-shaped adapter that is usable with the most preferred embodiment of the present invention for unclogging bathtub drains and sink drains.

FIG. 4 is a perspective view of the funnel-shaped adapter shown in FIG. 3.

FIG. 5 is a side view of an accordion plunger configured for unclogging toilets alone or via attachment to the most preferred embodiment of the present invention, with the distal end of the plunger shown in an expanded configuration.

FIG. 6 is a side view of an accordion plunger adapter for unclogging toilets alone or via attachment to the most preferred embodiment of the present invention, with the distal end of the plunger shown in an at least partially collapsed configuration.

DETAILED DESCRIPTION OF THE INVENTION

Figure 1:
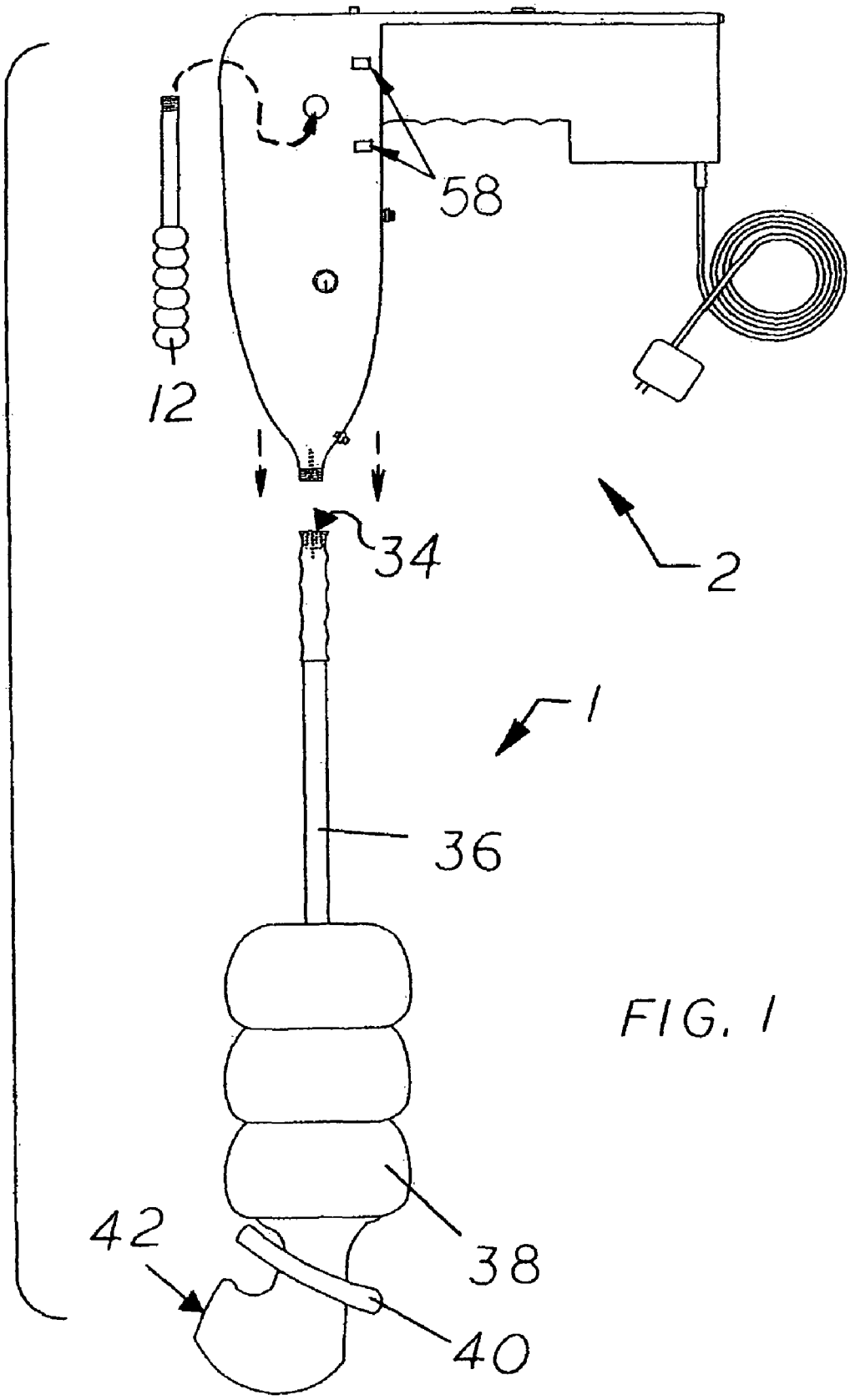
FIG. 1 is an exploded view of the most preferred embodiment of the present invention in a gun-shaped configuration and housing a small air compressor that is in fluid communication with an adjacent air chamber via a one-way valve positioned between the air compressor and the air chamber that only lets air into the air chamber, an optional handle detached from its usable position on the side of the air chamber, clips for handle attachment between uses, an optional power cord connected to the housing, and an optional accordion plunger adapter for unclogging toilets that is also detached from its usable position over the discharge opening of the air chamber, which in such a detached condition can be independently employed for toilet unclogging use.
Figure 2:
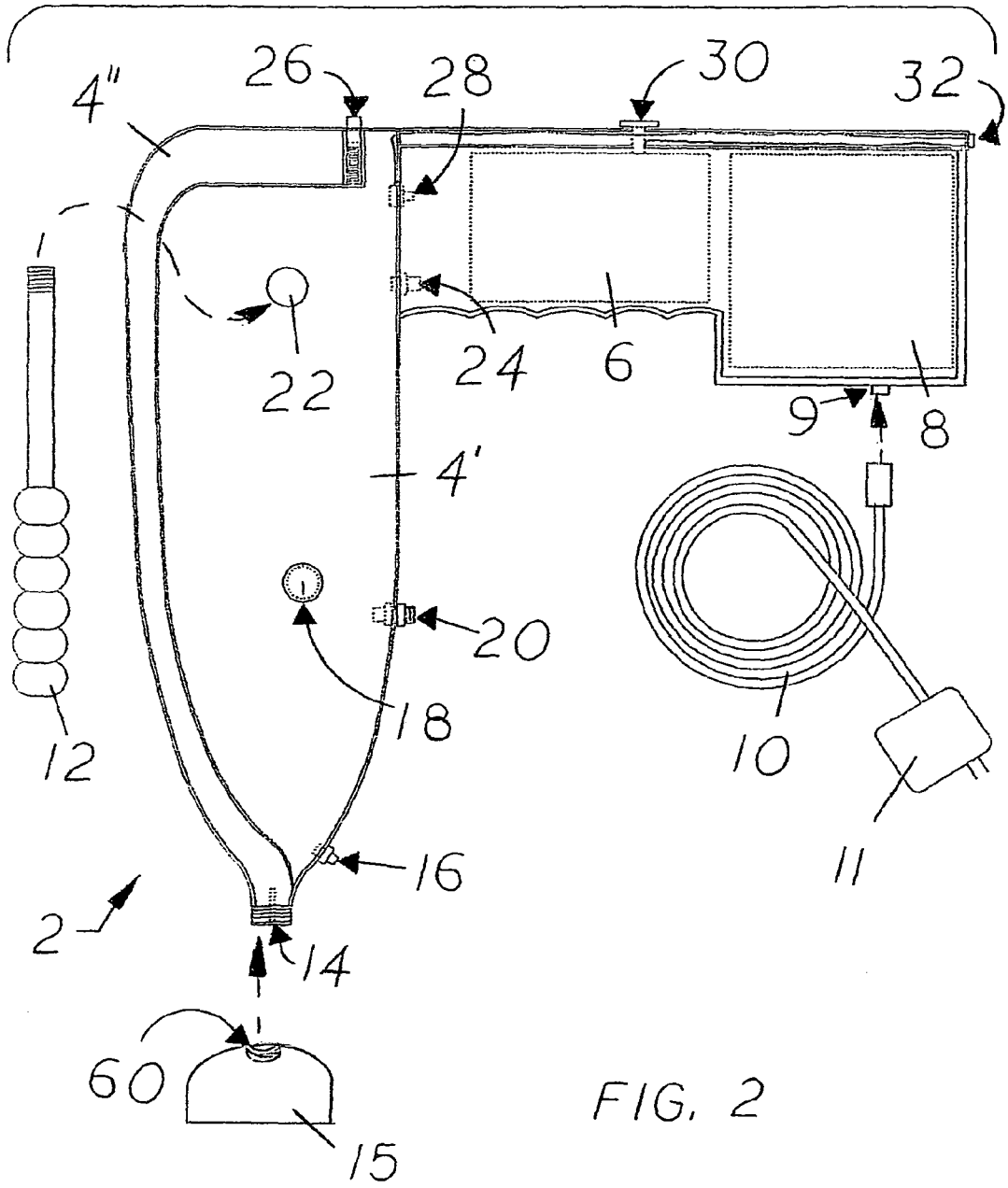
FIG. 2 is a sectional view of the most preferred embodiment of the present invention in a gun-shaped configuration and housing a means of battery power, a small air compressor that is in fluid communication with an adjacent air chamber via a one-way valve positioned between the air compressor and the air chamber that only allows movement of air into the air chamber, a pressure switch in working engagement with the air chamber and the compressor that monitors air pressure in the air chamber and then shuts off the compressor when the air pressure in the chamber exceeds a threshold amount selected by the operator, a discharge opening in the air chamber having a valve-opening pin, an air-release button associated with the air chamber for providing drain-unclogging air bursts through the air chamber's discharge opening, a one-way tire valve connected to the air chamber that is configured for release of air from the air chamber at a rate suitable for filling tires and other inflatable objects, a safety-release valve configured for release of excess pressure from said air chamber beyond a pre-selected threshold air pressure considered safe, an air pressure gauge configured for visual identification of current air pressure in the air chamber, a recess in the air chamber's outer surface for receipt of a handle, a power cord jack associated with the housing, a PSI setting means associated with the air compressor, an on-off switch, a handle detached from the recess in the side of the air chamber, a power cord detached from the housing, and a hollow cup adapter configured for unclogging shower drains and kitchen sink drains poised for connection below the discharge opening of the air chamber.
Figure 7:
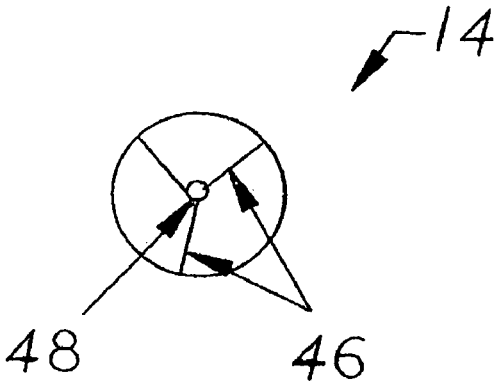
FIG. 7 is an end view of the discharge opening in the air chamber of the most preferred embodiment of the present invention having a built-in valve-disengaging pin and braces supporting the pin in its usable position.
Figure 9:
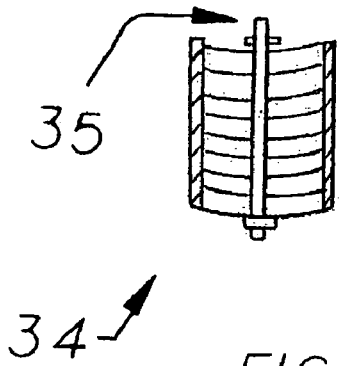
FIG. 9 is a sectional view of a preferred check valve used with an accordion plunger adapter in the most preferred embodiments of the present invention.
Figure 8:
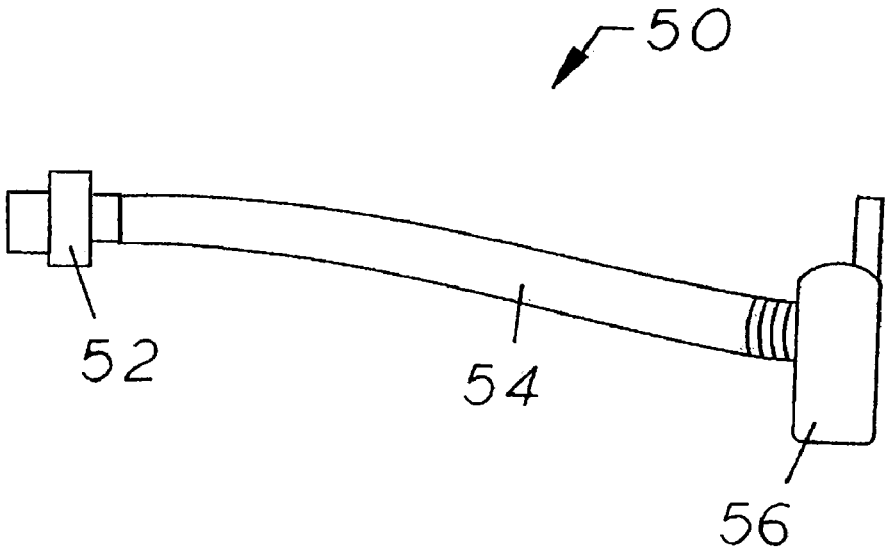
FIG. 8 is a side view of tire valve attachment configured for use with the most preferred embodiment of the present invention for engaging the one-way tire valve on the air chamber and transferring air from the air chamber at a rate suitable for filling tires.

FIG. 1 shows preferred components of the most preferred embodiment of the present invention (including an optional handle 12) and an accordion plunger adapter 1 used for unclogging toilets (not shown), with FIG. 2 showing the preferred interior structure of the hand-held gun-shaped (or L-shaped) device held by an operator (not shown) and a hollow cup-shaped adapter 15 used with it for clearing soft stoppages in shower and kitchen drains. FIGS. 7 and 9 respectively show a preferred configuration for the built-in pin 48 in an air or a main discharge opening 14 of the air chamber 4 and a cross-sectional configuration of a preferred check valve 34 used in accordion plunger adapter 1, which is engaged by built-in pin 48. In addition, FIGS. 3-6 show preferred adapters 44 and 1 used for attachment to the discharge opening 14 of air chamber 4 for unclogging drains. FIGS. 3 and 4 show a funnel-shaped adapter 44 used for unclogging bathtub drains and sink drains, while FIGS. 5 and 6 respectively show the accordion plunger adapter 1 of FIG. 1 in its expanded and collapsed positions that are needed when accordion plunger adapter 1 is used alone to mechanically clear a clog from a drain without the assistance of air chamber 4. FIG. 8 shows a tire valve attachment 50 configured for use with the most preferred embodiment of the present invention while engaging a one-way tire valve 16 on air chamber 4, which without a risk of overfill allows for substantially even transfer of air from air chamber 4 (not forceful air bursts) to a tire or other inflatable object (not shown) until an operator-selected pressure (set via PSI setting dial or display 30) is reached within the tire or other inflatable object wherein pressure switch 28 automatically shuts of compressor 6. Although FIGS. 1-9 show a good representation of the features of the present invention, it should be remembered that FIGS. 1-9 are not drawn to scale.

FIGS. 1 and 2 both show the most preferred embodiment of the present invention drain unclogging device 2 having a gun-shaped configuration and housing a small air compressor (marked in FIG. 2 by the number 6) that is in fluid communication with an adjacent air chamber (marked in FIG. 2 by the number 4) with a one-way valve 24 positioned between air compressor 6 and air chamber 4 that only lets air travel into air chamber 4. The substantially gun-shape or L-shape configuration includes a hollow handle portion that houses the small air compressor 6, and the air chamber 4 is connected to and in fluid communication with the hollow handle portion. FIGS. 1 and 2 also show an optional handle 12 detached from the side of air chamber 4 and a recess (marked in FIG. 2 by the number 22) in the exterior of air chamber 4 that is used to mount handle 12 for enhanced operator leverage of device 2 during its operation to unclog a drain (not shown). Although the exact location of recess 22 can be varied, it generally would be high on air chamber 4 so that handle 12 does not get wet during its use to clear a drain and thereby reduce operator grip. In addition, although not shown, it is preferred for handle 12 to be made from hard plastic and secured between uses in an out-of-the-way location on device 2, using clips 58, snaps, loops, and/or other mounting means, for easy operator access to handle 12 when needed. FIGS. 1 and 2 also both show a power cord 10, with FIG. 2 showing power cord 10 detached from a power cord jack 9. The positioning of power cord jack 9 is not critical and, although not shown, in other non-distinct embodiments of the present invention power cord jack 9 may be located in a position other than that shown in FIG. 2. FIG. 1 also shows an accordion plunger adapter 1 used for unclogging toilets alone or in combination with device 2. FIG. 1 shows accordion plunger adapter 1 having a rigid handle 36, a collapsible portion 38, an air burst discharge opening 42, and a seal 40 positioned between collapsible portion 38 and air burst discharge opening 42. In addition, FIG. 1 shows the check valve 34 on its proximal end that is connected to the air chamber discharge opening 14 shown in FIGS. 1 and 2, and marked by the number 14 in FIG. 2. The air chamber 4 is configured and constructed for holding compressed air. The air chamber 4 includes a sealed chamber 4' for holding compressed air and an air-flow passage 4". The air-flow passage 4" having a first end (where element 26 is shown) that is in fluid communication with the sealed chamber and a second end (where element 14 is shown). The second end of the air-flow passage has the main discharge opening 14 with the built-in pin 48 secured by braces 46. As illustrated in FIG. 2, the air chamber 4 is positioned perpendicular to the hollow handle portion such that the main discharge opening 14 is not in linear alignment with the air compressor 6 (forming the L-shaped configuration). FIG. 7 shows greater detail of the discharge opening 14 with its male threads and built-in pin 38 secured by braces 46, with built-in pin 48 configured for disengaging the seat 35 of the internally-threaded check valve 34 shown in FIG. 9 for allowing the forceful movement of new air bursts to travel from air chamber 4 toward a soft stoppage in a clogged drain to remove it. Since discharge opening 14 has male threads, it is intended for all adaptors (1, 15, 44, and other) used with air chamber 4 to have female threads. Although FIG. 2 does not show accordion plunger adapter 1, it shows internal structure of device 2 not revealed in FIG. 1, including a source of battery power 8, a small air compressor 6 that is in fluid communication with an adjacent air chamber 4 via a one-way valve 24 positioned between the air compressor 6 and the air chamber 4 that only allows movement of air into air chamber 4. As shown in FIG. 2, the hollow handle portion houses the source of battery power 8. It is preferred for battery power 8 to comprise one or more rechargeable batteries or battery-paks (although non-rechargeable batteries are also considered to be within the scope of the present invention), which would be able to be detachable and connected in their usable positions via common battery attachment means, such as but not limited to a sliding and/or snap-fit connection. FIG. 2 further shows a pressure switch 28 positioned between air compressor 6 and air chamber 4 that monitors air pressure in air chamber 4 and then shuts off compressor 6 when the air pressure in air chamber 4 exceeds a pre-selected threshold amount needed to supply a drain-unclogging burst of air (not shown). The locations of one-way valve 24 and pressure switch 28 between air compressor 6 and air chamber 4 are not critical and can be different from that shown. FIG. 2 also shows the air-release button 26 disposed at the second end of the air flow passage 4" and associated with air chamber 4 for providing drain-unclogging air bursts through the air chamber's discharge opening 14, a one-way tire valve 16 connected through the wall of air chamber 4 that is configured for substantially even release of air (not shown) from air chamber 4 for filling bicycle or automobile tires (not shown) to a pressure pre-selected by an operator using the PSI setting dial or display 30 associated with air compressor 6, a manually-operated on-off switch 32 for engaging the air compressor, and a safety-release valve 20 configured for release of excess pressure from said air chamber beyond a pre-selected threshold air pressure considered safe, and an optional air pressure gauge 18 configured for visual identification of current air pressure in air chamber 4. Further, FIG. 2 shows the PSI setting dial or display 30 that is used for selectively setting of a maximum air pressure level for movement of air from air compressor 6 into air chamber 4 for either drain unclogging or tire filling use. The locations of air-release button 26, one-way tire valve 16 safety-release valve 20, on-off switch 32, PSI setting means 30, and air pressure gauge 18 on device 2 are not critical and can be different from that shown, although it is preferred for safety-release valve 20 and air pressure gauge 18 to be in high locations on air chamber 4 so that they do not become wet and remain visible the entire time during which a drain is being cleared. In addition, FIG. 2 shows a hollow cup adapter 15 configured for unclogging shower drains and kitchen sink drains (not shown) poised for connection below discharge opening 14 of air chamber 4. FIG. 2 also shows hollow cup adapter 15 marked with the number 60 to indicate that it has female threads only and no check valve similar to the proximal end of accordion plunger adapter 1. Removal of a strainer plate over a bathtub drain is not required prior to use with hollow cup adapter 15. In contrast, the strainer plate over a shower drain would usually have to be removed prior to use of the funnel-shaped adapter 44 shown in FIGS. 3 and 4. It is preferred for hollow cup adapter 15 and funnel-shaped adapter 44 to be made from flexible material, such as semi-hard rubber that flexes but is able to recover its original configuration. During use of device 2, on-off switch 32 can be engaged to turn air compressor 6 on and off to fill air chamber 4 prior to its release of forceful drain unclogging air bursts. However, on-off switch 32 is also used for activating compressor 6 so that device 2 can be used to deliver substantially even air flow (not forceful air bursts) through one-way tire valve 16 to transfer compressed air from air chamber 4 into a tire or other inflatable object (not shown). Compressor 6 runs the entire time a steady flow of air is discharged through one-way tire valve 16, unless prematurely shut off by on-off switch 32. However, when the PSI in the tire or object reaches the PSI initially set by the operator using the PSI setting dial or display associated with air compressor 6, pressure switch 28 automatically shuts off compressor 6. However, if battery power 8 runs down, then power cord 10 is attached to power cord jack 9 to provide power for the operation of air compressor 6 with simultaneous recharging of the on-board battery 8. However, when air chamber 4 needs to have a new charge of air, it is not contemplated for automatic recharge of air chamber 4. On-off switch 32 must first be engaged by an operator before air compressor 6 will start. Although not shown, to obtain digital readout of the PSI setting dial, separate batteries will be required, such as at least two AAA batteries.

FIGS. 3-6 show preferred adapters 44 and 1 used for attachment to the discharge opening 14 of air chamber 4 for directing an air burst from air chamber 4 into a drain (not shown) to clear it. FIGS. 3 and 4 show a funnel-shaped adapter 44 used for unclogging bathtub drains and sink drains (not shown), while FIGS. 5 and 6 show the accordion plunger adapter 1 previously shown in FIG. 1 respectively in the expanded and collapsed positions that allow independent mechanical drain unclogging use without connection to device 2. FIG. 3 is a side view of a funnel-shaped adapter that is usable with the most preferred embodiment of the present invention for unclogging bathtub drains and sink drains, while FIG. 4 is a perspective view that shows the female threads 60 within funnel-shaped adapter 44 that is marked. FIG. 5 is a side view of an accordion plunger adapter 1 configured for unclogging toilets alone or via use of device 2, with the collapsible portion 38 of accordion plunger adapter 1 shown in an expanded configuration, while FIG. 6 shows collapsible portion 38 in at least a partially collapsed configuration with a downwardly directed arrow showing the direction of force required to move the collapsible portion 38 of accordion plunger adapter 1 into a more compacted configuration during the mechanical clearing of a drain clog when accordion plunger adapter 1 is used independently from device 2. A collapsed configuration is required for use with air chamber 4. FIGS. 5 and 6 show accordion plunger adapter 1 having a rigid handle 36, a collapsible portion 38, an air burst discharge opening 42, and a seal 40 positioned between collapsible portion 38 and air burst discharge opening 42. For convenience of operator use, it is preferred that seal 40 be an incorporated or built-in part of collapsible portion 38. In addition, FIGS. 5 and 6 show with broken lines the reinforcement material 39 preferably positioned at and around the interface between handle 36 and collapsible portion 38 to deflect and distribute some of the plunging force away from the end of handle 36 and thereby extend the useful life of the semi-hard material typically used to manufacture collapsible portion 38. Reinforcement material 39 can be in the form of a semi-flexible plate, bonded fabric, or any other common means of reinforcement configured and positioned outside and/or inside collapsible portion 38 to keep collapsible portion 38 from experiencing premature failure. FIGS. 5 and 6 further show the check valve 34 on the proximal end of accordion plunger adapter 1 that is connected to the discharge opening 14 shown in FIGS. 1 and 2, and marked by the number 14 in FIG. 2. Optionally, although in FIGS. 1, 5 and 6 the built-in seal 40 is shown to be angled relative to collapsible portion 38 and not extend beyond it, the angle of built-in seal 40 may be different from than that shown in FIGS. 1, 5 and 6, and its diameter dimension may be longer or shorter than illustrated.

Below FIGS. 7 and 9, FIG. 8 shows a side view of a tire valve attachment 50 configured for use with device 2 and having an attachment proximal end 52 configured for engaging the one-way tire valve 16 on air chamber 4. Once air compressor 6 is activated, substantially even transfer of air (not shown) from air chamber 4 is achieved through one-way tire valve 16, with the transferred air passing through tire valve attachment 50 via an attachment distal end 56 and entering the automobile tire, bicycle tire, or other inflatable object (not shown) connected to distal end 56. Once a pressure pre-selected by the operator via PSI setting dial or display 30 is reached in the automobile tire, bicycle tire, or other inflatable object (not shown) connected to distal end 56, pressure switch 28 automatically shuts of compressor 6. Thus, overfilling of the tire or other inflatable object is avoided. Although not limited thereto, for operator convenience it is preferred for the proximal end 52 and the distal end 56 of tire valve attachment 50 to have quick-disconnect or threaded configurations. It is also contemplated for use of the air chamber 4 in device 2 as a mini compressor for filling tire and other inflatable objects to be commenced through use of on-off switch 32, and not air-release button 26. Compressor 6 would run during the entire time of air transfer to a tire or other inflatable object, with shut off of compressor 6 being automatically performed by pressure switch 28, although premature operator shut off of compressor 6 could be achieved through use of on-off switch 32. Safe cleaning of air conditioner condensate lines (not shown) is also a contemplated use of device 2, as long as the operator sets a low air pressure via the PSI setting dial to provide a low pressure burst of air. Also, although not shown but similar to the clipping of handle 12 previously discussed above, it is contemplated for device 2 to optionally have clips 58 for the attachment of tire valve attachment 50 in an out-of-the-way position on air chamber 4 (or other part of device 2) so that it is easily accessible for operator use whenever needed. When tire valve attachment 50 is clipped via clips 58 to device 2 for easy access, it should not have a length dimension greater than that of device 2 so that interference with operator use is avoided. Also, it should be understood that the illustration of clips 58 is merely a representation thereof and the actual configuration and dimension of the mounts used for securing handle 12 or tire valve attachment 50 against device 2 in a readily accessible position can be different from that shown. Further, although both clips 58 are shown in FIG. 1 to have the same shape and size, mounts of different shapes can be used, as well as a different number of mounts and different locations that shown.

What is claimed is:

1. A portable hand-held device for unclogging and clearing a soft stoppage from a single non-vented drain, said hand-held device comprising:

a substantially L-shape configuration including a hollow handle portion and an air chamber connected to and in fluid communication with said hollow handle portion, said hollow handle portion houses a battery power and a small air compressor, wherein said battery power provides sufficient power for operation of said air compressor, and wherein said air compressor supplying compressed air to said air chamber via a manually-operated on-off switch, a one way valve positioned between said air compressor and said air chamber, wherein said one way valve allows compressed air only to flow from said air compressor into said air chamber, a pressure switch positioned between said air compressor and said air chamber, wherein said pressure switch monitors air pressure in said chamber and deactivates said air compressor if the pressure inside said air chamber exceeds a pre-selected threshold amount needed, a PSI setting dial or display used for selectively setting of a desired air pressure level, said PSI setting dial or display disposed on said hollow handle portion and connected with said air compressor;

said air chamber configured and constructed for holding compressed air, said air chamber comprises a sealed chamber for holding compressed air and an air-flow passage, said air-flow passage having a first end that is in fluid communication with said sealed chamber and a second end, said second end of said air-flow passage having a main discharge opening with a built-in pin secured by braces, wherein said main discharge opening comprising male threads, wherein said air chamber is positioned perpendicular to said hollow handle portion such that said main discharge opening is not in linear alignment with said air compressor, an air-release button disposed at said second end of said air flow passage on said air chamber, wherein when said air-release button is manually actuated, compressed air from said sealed chamber of said air chamber flows into said air-flow passage and exits from said main discharge opening to produce a forceful air burst toward the stoppage to remove it;

said air chamber further comprises a recess formed on a side of the air chamber, said recess is used to receive a detachable handle for facilitating operator leverage of the hand-held device during its operation, a one-way tire valve formed though a wall of said sealed chamber of said air chamber for releasing compressed air to inflate a tire, a tire valve attachment having an attachment proximal end for engaging said one-way tire valve and an attachment distal end adapted to engage the tire, an air pressure gauge positioned on said sealed chamber and configured for visual identification of the air pressure inside said sealed chamber of said air chamber, a safety-release valve disposed on said sealed chamber and configured for releasing excess air pressure inside said sealed chamber of said air chamber; and drain-sealing adapter equipped with a proximal end having female threads configured for engagement with said male thread of said main discharge opening, said drain-sealing adapter connects to said main discharge opening of said air chamber via said proximal end, interacts with said built-in pin, and allows one-way air flow from said air chamber to said drain-sealing adapter, said drain-sealing adapter also being equipped with an opposed distal end configured for providing substantially airtight sealing of a drain opening of the single non-vented drain and further adapted for allowing air entering said proximal end to travel to said distal end without diminishment, so that when said proximal end of said drain-sealing adapter is connected to said main discharge opening of said air chamber and operation of said air compressor has caused air pressure build-up in said air chamber at least to said desired air pressure level established by said PSI setting dial or display, and said hand-held device is held by an operator with said distal end of said drain-sealing adapter covering the drain opening of the single non-vented drain and providing a substantially airtight seal over the drain opening, manual activation of said air-release button releases a forceful air burst from said seal chamber of said air chamber that travels through said air-flow passage and said drain-sealing adapter and subsequently enters the drain below the covered drain opening, thereafter forcefully contacting any soft stoppage in the drain to move the soft stoppage and clear it from the drain.

2. The device of claim 1 wherein said drain sealing means is selected from a group consisting of adapters configured to seal shower and kitchen sink drains, adapters configured to seal bathtub and sink drains, and adapters configured to seal a toilet discharge opening.

3. The device of claim 2 wherein said adapters configured to seal a toilet discharge opening further comprise at least one accordion plunger adapter.

4. The device of claim 3 wherein said at least one accordion plunger adapter has a collapsible plunger portion connected to one end of a rigid handle and said collapsible plunger portion is configured for movement between a fully expanded configuration and a fully collapsed configuration that allows for independent mechanical drain unclogging use thereof without air from said air chamber, and said at least one accordion plunger adapter further comprises reinforcement means adapted to deflect and distribute forces applied via said handle against said at least one accordion plunger adapter away from the connection between said handle and said collapsible plunger portion, said reinforcement means being positioned between said collapsible plunger portion and said rigid handle.

5. The device of claim 2 wherein said adapters configured to seal shower drains and kitchen sink drains further comprise at least one hollow cup adapter.

6. The device of claim 2 wherein said adapters configured to seal bathtub drains and sink drains further comprise at least one funnel-shaped adapter.

7. The device of claim 1 wherein said batter power is detachable.

8. The device of claim 1 wherein said batter power is selected from a group consisting of detachable batteries, rechargeable batteries, power cords, and detachable power cords.

* * * * *